US006086400A

United States Patent [19]

Fowler

[11] Patent Number: 6,086,400

[45] Date of Patent: Jul. 11, 2000

[54] SELF-LOCKING CABLE CONNECTOR COUPLING

[75] Inventor: Clifford C. Fowler, Chatsworth, Calif.

[73] Assignee: Electro Adapter, Inc., Chatsworth, Calif.

[21] Appl. No.: 08/953,691

[22] Filed: Oct. 17, 1997

[51] Int. Cl.[7] ..... H01R 4/38

[52] U.S. Cl. ..... 439/321; 439/320

[58] Field of Search ..... 439/312–323, 439/328

[56] References Cited

U.S. PATENT DOCUMENTS

| | | | |
|---|---|---|---|
| 3,465,092 | 9/1969 | Schwartz | 439/609 |
| 4,154,496 | 5/1979 | Gallagher | 439/578 |
| 4,597,620 | 7/1986 | Lindner et al. | 439/578 |
| 4,629,272 | 12/1986 | Mattingly et al. | 439/318 |
| 4,793,821 | 12/1988 | Fowler et al. | 439/321 |
| 4,941,846 | 7/1990 | Guimond et al. | 439/578 |
| 5,035,640 | 7/1991 | Drogo | 434/321 |
| 5,192,219 | 3/1993 | Fowler et al. | 439/321 |
| 5,366,383 | 11/1994 | Dearman | 439/321 |
| 5,399,096 | 3/1995 | Quillet et al. | 439/321 |
| 5,580,278 | 12/1996 | Fowler et al. | 439/609 |

FOREIGN PATENT DOCUMENTS 2 187 050 2/1990 United Kingdom .

*Primary Examiner*—Hien Vu

*Attorney, Agent, or Firm*—Pretty, Schroeder & Poplawski, P.C.

[57] ABSTRACT

A cable connector coupling having a nut for attachment to a cable connector and a body joined to the nut so that the cable of the cable connector passes through the nut and body, the nut having a first internal annular groove and the body having a first external annular groove, with a lock ring positioned in the first grooves so that the nut and body translate axially together, an annular engagement ring positioned around the body for sliding axially on the body, the engagement ring having a second internal annular groove and the body having a second external annular groove, with a drive ring positioned in the second grooves, with the nut and engagement ring axially interengaging for varying the overall axial length of the nut and body as the nut is rotated relative to the body, with the body and engagement ring interengaging for limiting rotation of the engagement ring relative to the body, and with the drive ring and body interengaging for urging the engagement ring and nut into engagement for limiting rotation of the body relative to the nut.

27 Claims, 9 Drawing Sheets

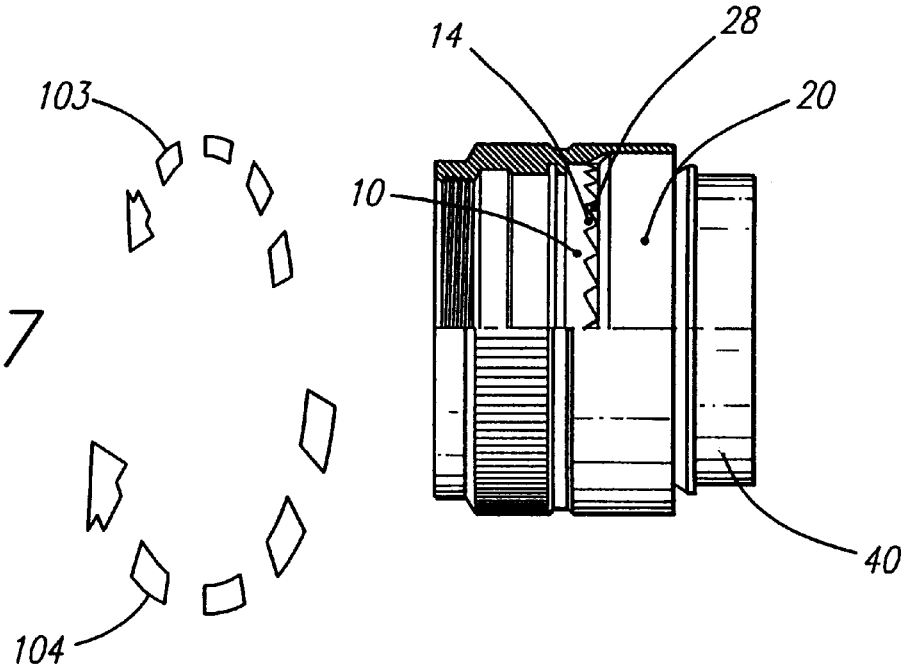
FIG. 7
FIG. 8
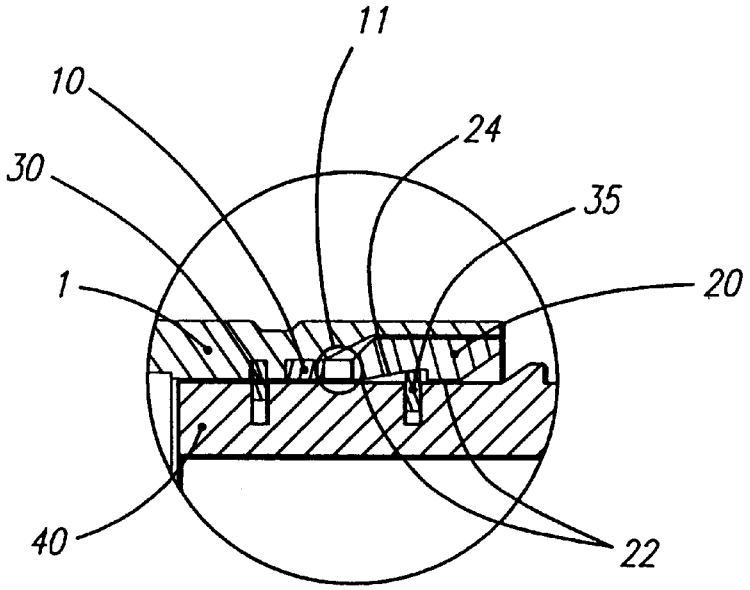

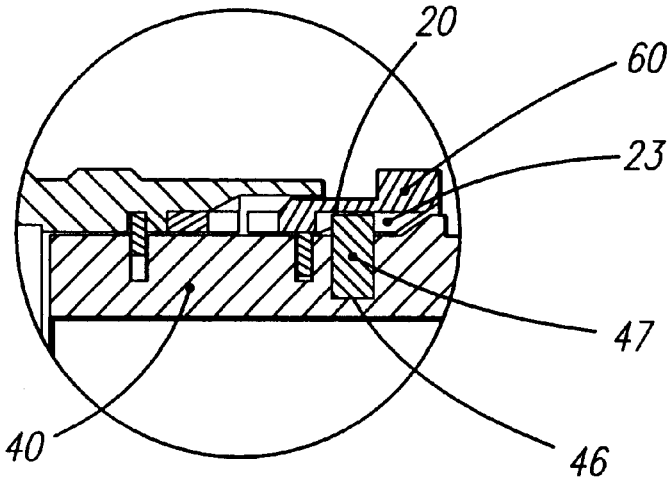
FIG. 15
FIG. 16
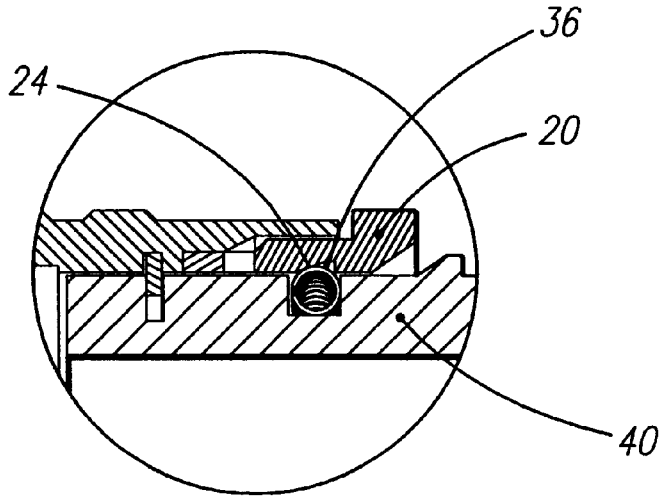

SELF-LOCKING CABLE CONNECTOR COUPLING

BACKGROUND OF THE INVENTION

1. Field of Invention

The present invention relates to self-locking connector/adapter interfaces or cable connector couplings. This type of coupling is normally comprised of a threaded nut to mate to an electrical connector, a tubular body with connector engagement features as required for a given connector, a locking device which interfaces between the nut and body and a method for retaining the parts in a fixed relation to properly mate with the connector. The coupling is also referred to as a back shell.

2. Description of Prior Art

Rachet Type

Since the early 1980's aircraft manufacturers and the military have sought to eliminate safety wiring, thread sealants and other methods of securing a threaded interface, under service conditions such as shock, vibration, "G" loading, etc., with a self-contained device. Adapter manufacturers responded with several designs to meet this need. Most required an increase in the overall diameter of the coupling with a corresponding increase in length. A few maintained the existing dimensions but they had the same problem as the others, minimal or sporadic locking contact points. This type of device was written into MIL-C-85049 in 1990.

All of the above incorporated a spring type device, located in the body or nut of the coupling with matching detents in the counterpart component. The spring was radially loaded perpendicular to the axis of the body centerline. One to three spring devices have been used. A single spring tends to force the coupling to an eccentric position opposed to the body. Three springs correct this but only have a contact or locking point every 120 degrees.

Another problem associated with these minimal contact locking couplings was that the pre-set assembly torque, set at assembly, could be unintentionally released under field use conditions through improper or rough handling of the assembly.

An example of this construction is seen in U.S. Pat. No. 4,793,821.

Anti-rotation Locking Type

In 1991, a coupling interface was developed to cure the above problems with the rachet type coupling, based on equally spaced radial contact (locking) points to eliminate eccentricity and with a manual release/engage feature. When engaged, this feature made the interface a true positive anti-rotation type device. To release the lock, it had to be an intentional act of the person needing to inspect or repair the cable assembly.

As with the rachet type, the dimensional envelope grew but still had spaced radial contact points. Spaced points transmit stress between the coupling and body by a segment type of finger, which if damaged or broken renders the entire assembly unusable.

A new problem, unique to this type of interface, is alignment of the locking elements. When the coupling is torqued to the required limit, the locking elements may not be aligned and the lock ring may not engage. This condition requires that the coupling ring be rotated until the lock ring can be engaged. This is acceptable as long as the rotation needed does not reduce or exceed the torque limits required for proper assembly function.

An example of this construction is seen in U.S. Pat. No. 5,192,219.

SUMMARY OF THE INVENTION

It is an object of the present invention to solve the various problems associated with the prior art while maintaining the previously established dimensional limits.

It is another object of the present invention to provide a stronger locking mechanism through the use of a full 360 degree, axially aligned, locking engagement.

It is yet another object of the present invention to eliminate unintentional release of the rachet type of locking device.

It is a further object of the present invention to provide automatic self-alignment and engagement of the locking surfaces.

It is yet a further object of the present invention to eliminate radial displacement of the coupling to the body maintaining a true concentric relationship as with a non-locking adapter.

It is yet a further object of the present invention to allow for verifying the assembly torque, on an anti-rotation type of locking device, after the locking mechanism is engaged.

It is yet a further object of the present invention to allow for assembly after plating. Some anti-rotation types are assembled prior to plating and cannot be inspected to verify if they are fully plated or have any plating at all. If not correctly plated, corrosion will develop and the assembly will not function.

It is yet a further object of the present invention to allow for tailoring the locking characteristics to a customer's requirements by adjusting internal dimensions to suit without changing the external envelope.

It is yet a further object of the present invention to provide a one time use type locking mechanism, such as required for missile launch umbilical cables. This type is pre-set at manufacture, and upon assembly to the connector and cable and engaged, cannot be disengaged by intent or accident.

A particular object of the invention is a cable connector coupling having a nut for attachment to a cable connector and a body joined to the nut so that the cable of the cable connector passes through the nut and body, with the nut having a first internal annular groove and the body having a first external annular groove, with a lock ring positioned in the first grooves so that the nut and body translate axially together. An annular engagement ring is positioned around the body for sliding axially on the body, the engagement ring having a second internal annular groove and the body having a second external annular groove, with a drive ring positioned in the second grooves, with the nut and engagement ring having axially directed first interengaging means for varying the overall axial length of the nut and body as the nut is rotated relative to the body, with the body and engagement ring having second interengaging means for limiting rotation of the engagement ring relative to the body, and with the drive ring and body having third interengaging means for urging the first interengaging means into engagement for limiting rotation of the body relative to the nut.

Preferably, the first interengaging means includes an annular toothed ring as part of the nut and a mating annular toothed ring as part of the engagement ring, with the toothed rings facing each other, the second internal annular groove of the engagement ring has a varying diameter and the drive ring is resilient providing a varying external diameter, and the second interengaging means includes means in the engagement ring defining an anti-rotation groove, and a means carried on the body for engagement with the groove.

A specific object of the invention is to utilize toothed rings which are uniform and continuous.

Other objects, advantages, features and results will more fully appear in the course of the following description.

BRIEF DESCRIPTION OF THE DRAWINGS

FIG. 7 is similar to FIG. 5, showing partially biased locking elements;

FIG. 8 is an enlarged detail of FIG. 4, showing the ratchet type locking elements in the full engaged position;

FIG. 15 is similar to FIG. 10, with the axial key as a separate component;

FIG. 16 is similar to FIGS. 10 and 14, showing one alternative lock ring drive element;

DESCRIPTION OF THE PREFERRED EMBODIMENTS

Figure 1:
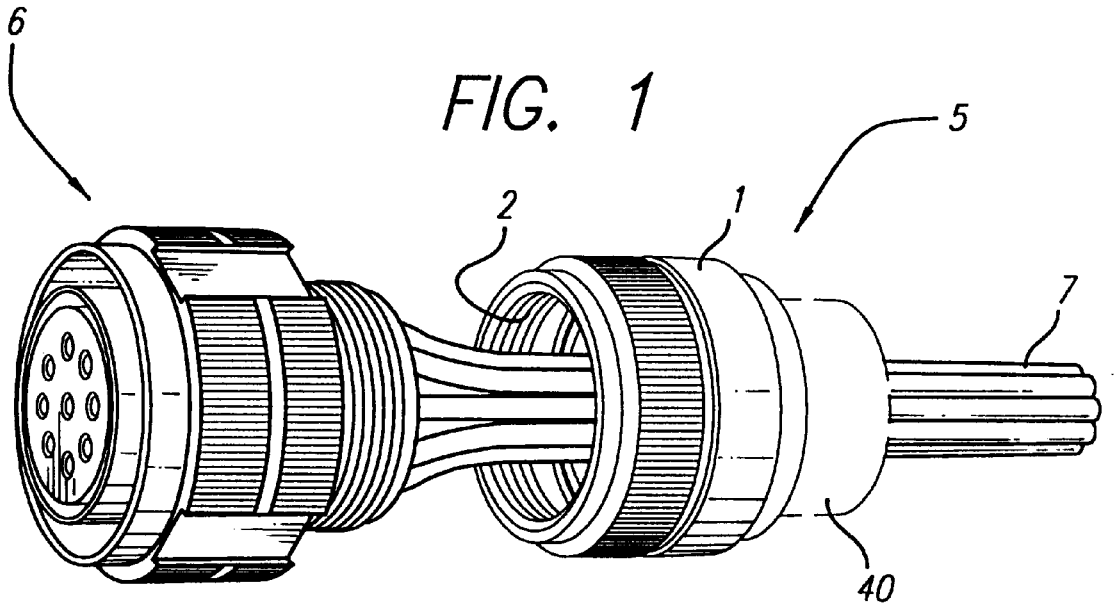
FIG. 1 is a partially exploded perspective view of a cable connector incorporating the coupling of the invention.
Figure 2:
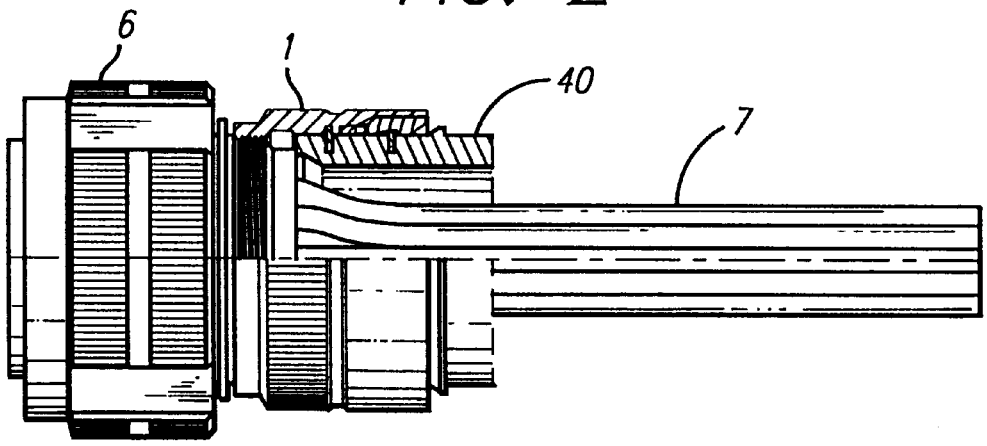
FIG. 2 is a side view, partially in section, of the connector of FIG. 1.
Figure 3:
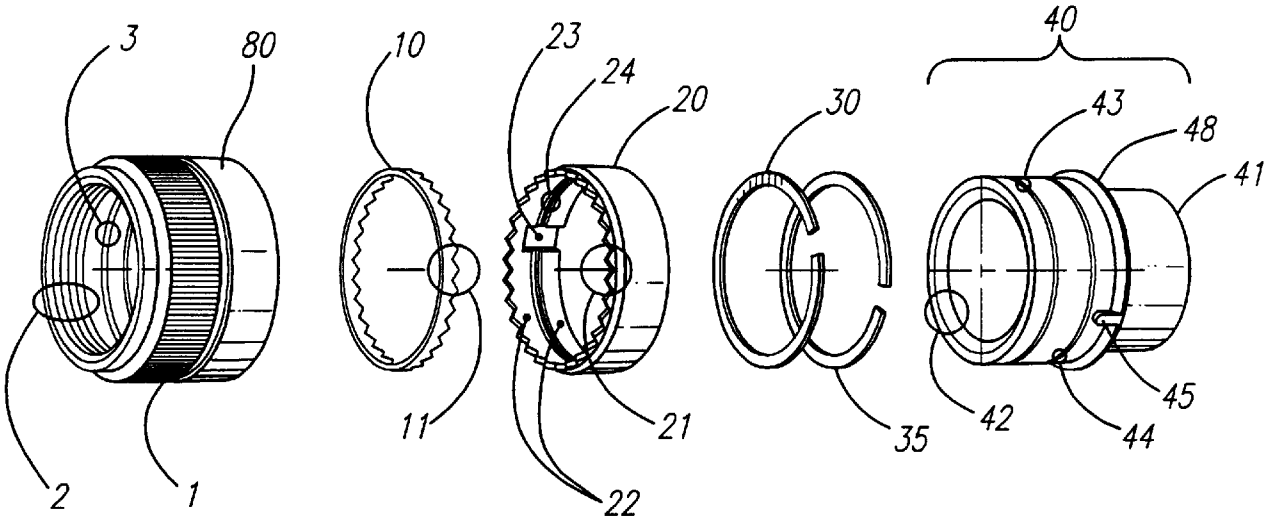
FIG. 3 is an exploded perspective view of a rachet type self-locking connector adapter interface, in accordance with the present invention.

In the presently preferred embodiment of the invention as shown particularly in FIGS. 1, 2 and 3, the cable connector coupling has a nut 1 for attachment to a cable connector 6, and a body 40 joined to the nut so that the cable 7 of the cable connector 6 passes through the nut and body. The nut has an internal annular groove 3 and the body has an external annular groove 43, with a lock ring 30 positioned in the grooves 3, 43 so that the nut and body translate axially together.

An annular engagement ring 20 is positioned around the body 40 for sliding axially on the body. The ring 20 has an internal annular groove 24 and the body has an internal annular groove 44, with a drive ring 35 positioned in the grooves 24, 44.

The nut and engagement ring have axially directed interengaging means for varying the overall axially length of the nut and body, as the nut is rotated relative to the body. In the preferred embodiment illustrated, a lock ring 10 is positioned within the nut 1 and has an annular row of teeth 11. Preferably the teeth are uniform in size and in shape and are continuous around the ring. The engagement ring 20 has a corresponding row of teeth 21. The teeth 11, 21 face each other. The locking ring 10 may be formed separate from the nut 1, as shown in FIG. 3, or may be formed integral with the nut, as desired. If formed separately, the locking ring may be held in place by press fit, brazing or the like to prevent rotation relative to the nut.

Figure 11:
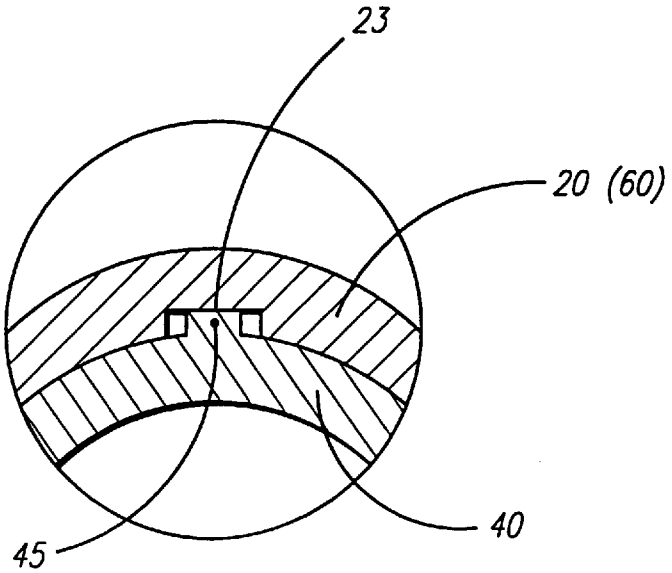
FIG. 11 is a rotated, sectional view showing the rotational allowance for the locking elements to self-engage.

The body 40 in the engagement ring 20 have interengaging means for limiting rotation of the engagement ring relative to the body. In the preferred embodiment, a key tab 45 on the body 40 engages an axial groove 23 on the engagement ring 20 for accomplishing this aim. See FIGS. 3 and 11.

The drive ring 35 is resilient, which permits the outside diameter of the drive ring to vary. Typically, this is accomplished by using a split ring of conventional design, as shown in FIG. 3. A drive groove 24 is provided in the engagement ring 20, with the diameter of the groove varying, preferably being conical. See FIG. 8. When the nut 1 is rotated on the connector 6, the body 40 is advanced as the nut advances, with the body being driven by the ring 30 which engages the nut and body. This forward movement of the body (to the left as seen in FIG. 8) moves the drive ring 35 to the left and urges the engagement ring 20 to the left. This motion brings the row of teeth 11 into engagement with the row of teeth 21, to the position shown in FIG. 5. Reverse motion of the nut permits movement of the engagement ring to the right as shown in FIG. 6, with the teeth 11, 21 moving away from each other. The movement of the ring 20 is illustrated by the arrows 101 and 102 in FIG. 6.

Figure 5:
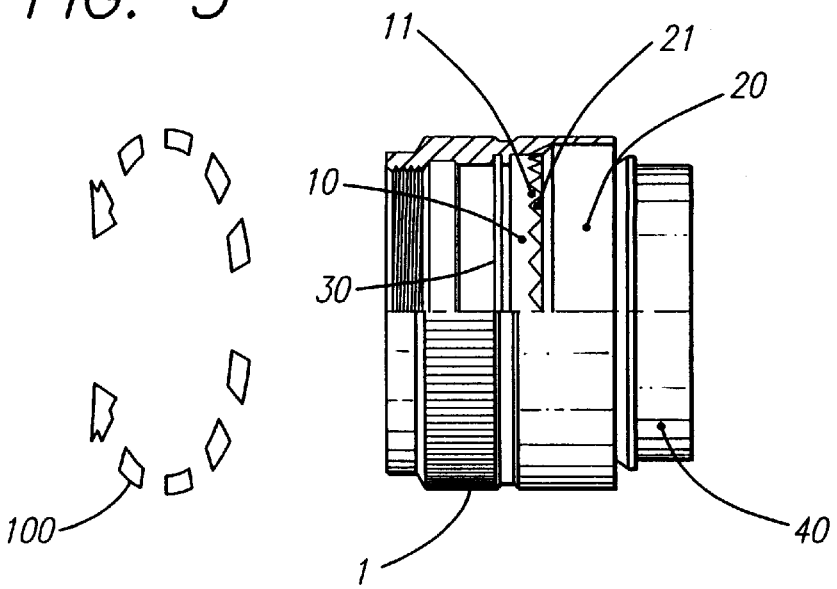
FIG. 5 is similar to FIG. 4, with the locking elements in full view, (non-biased)
Figure 6:
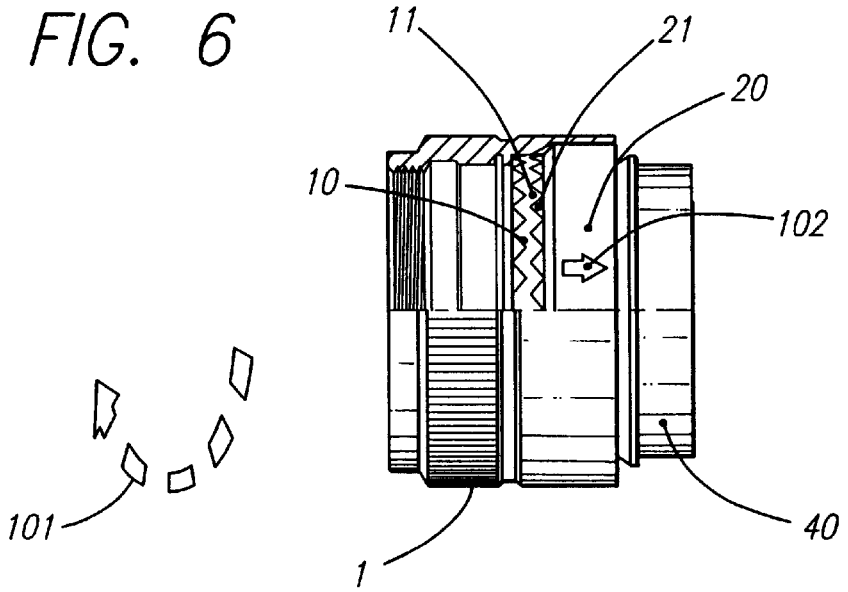
FIG. 6 is similar to FIG. 5, showing the interaction between the locking elements under partial rotation.

When the two rows of teeth are equal in profile, as in an isosceles triangle, a ratchet type operation is provided, with the nut being rotatable relative to the body in either direction, as illustrated in FIG. 5, with arrow ring 100. Rotation of the nut in the direction of the arrow 101 of FIG. 6, results in translation of the engagement ring to the right as shown by the arrow 102 in FIG. 6. This construction is sometimes referred to as a ratchet type construction, which permits relative rotation of the components in either direction.

In an alternative configuration for the teeth where the teeth are non-equal angle triangles, as shown in FIG. 7, the nut may be rotated in either direction, but considerable more force is required to rotate it in one direction as compared to the other, as shown in FIG. 7 with arrows 103, 104.

Figure 9:
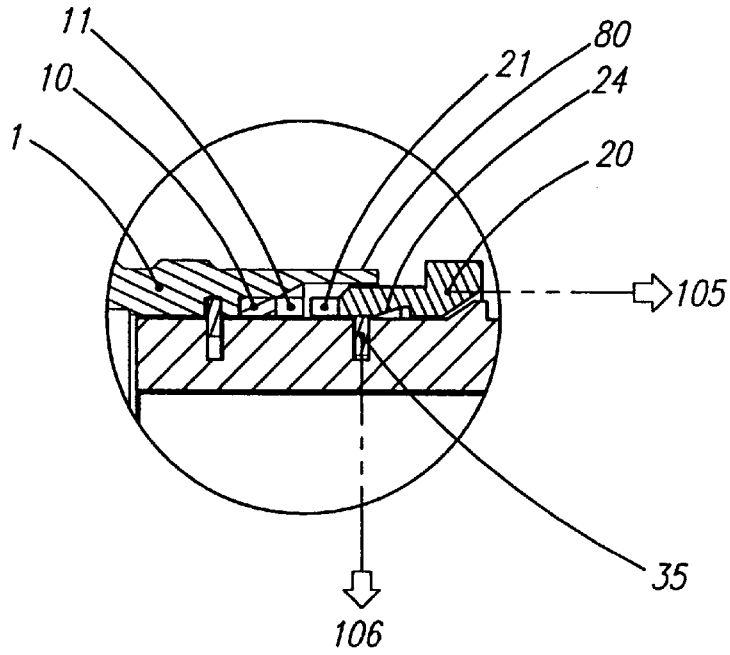
FIG. 9 is similar to FIG. 8, during rotation, with the locking elements passing each other.
Figure 13:
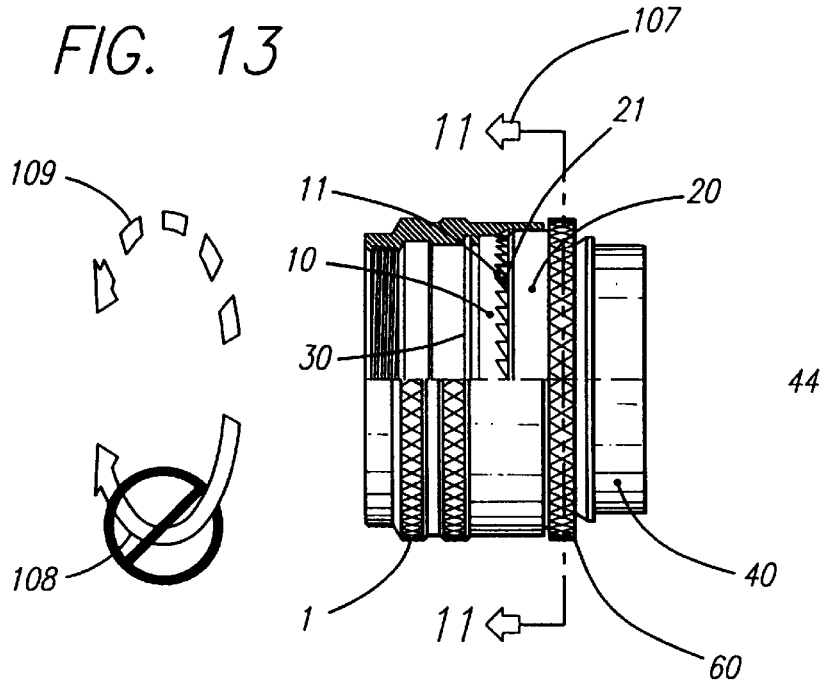
FIG. 13 is similar to FIG. 7, with fully-biased type locking elements in the engaged position.

In another alternative construction, sometimes referred to as an anti-rotation locking type, the teeth have a shape with one side parallel to the axis of the coupling and the other side oblique to the axis, as shown in FIG. 13. With this construction, the nut can be rotated in the direction 109 to tighten the coupling but cannot be rotated in the opposite direction 108. to loosen the coupling. In FIG. 8, the engagement ring is shown moved to the left to bring the two rows of teeth into full engagement. In FIG. 9, the engagement ring is moved to the right as shown by the arrow 105, compressing the ring 35 as shown by the arrow 106, and moving the rings of teeth 11, 21 out of engagement.

Figure 12:
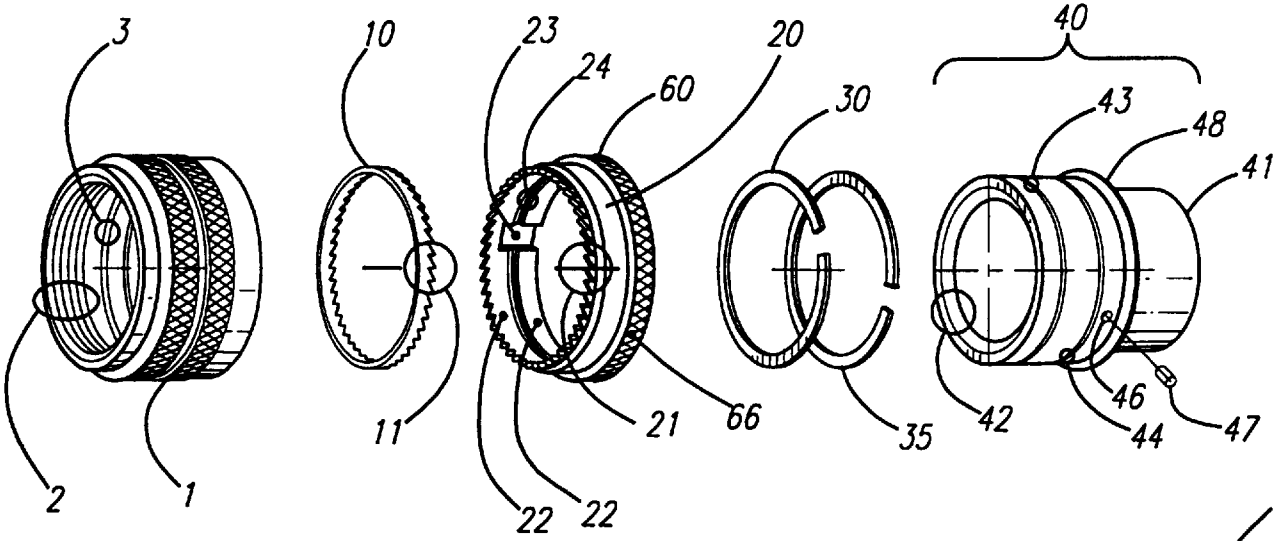
FIG. 12 is an exploded perspective view of an anti-rotation type self-locking connector adapter interface, in accordance with the present invention.

The anti-rotation locking type is shown in FIG. 12, where components corresponding to those of FIG. 3 are identified by the same reference numerals. The teeth 11 and 21 have the shape of FIG. 13. A pin 47 is positioned in a hole 44 in the body 40 to perform the same function as the key tab 5 in the embodiment of FIG. 3. An outer rim 60 may be provided on the engagement ring 20 for manual unlocking of the engagement ring.

Figure 14:
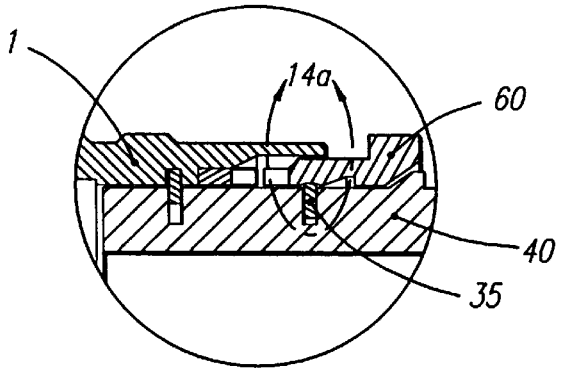
FIG. 14 and 14*a* are similar to FIGS. 8 and 9, showing an optional pull back detent type.
Figure 14A:
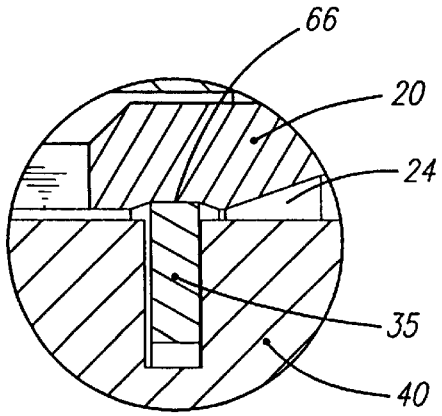

In one alternative construction, a pull-back detent may be utilized, as shown in FIGS. 14 and 14*a*. In this construction, a flat bottom groove 66 is provided in the engagement ring adjacent the conical drive groove 24. This construction may be utilized for maintaining the coupling in the non-tooth engagement condition. The ring is pulled to the right, typically be grasping the enlarged rim 60. This moves the drive ring 35 out of the drive groove 24 and into the detent groove 66. When it is desired to actuate the coupling to engage the teeth, the drive ring 20 is pushed to the left to the position of FIG. 4.

Figure 4:
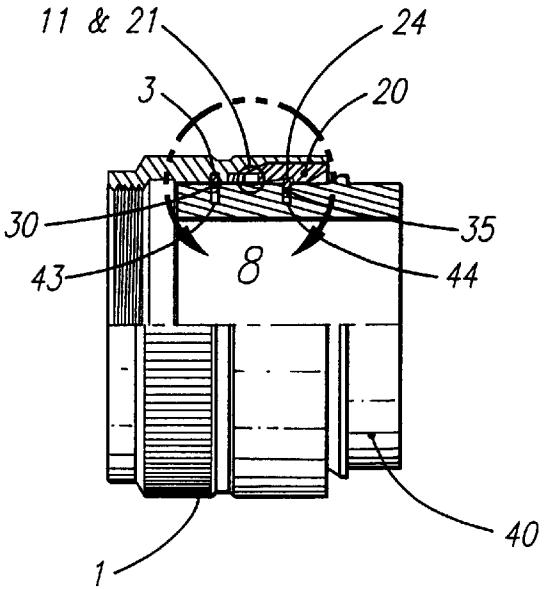
FIG. 4 is a partial longitudinal section view of a rachet type connector adapter showing the components in the assembled condition.
Figure 10:
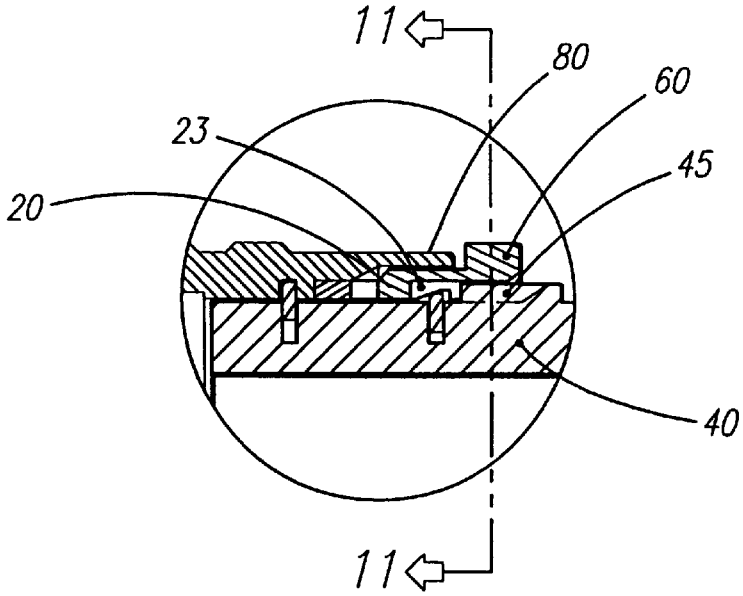
FIG. 10 is a rotated sectional view through the axial key.

In one of the embodiments, the inner flange end 80 of the nut 1 overlys and terminates approximately at the corresponding end of the engagement ring 20, as seen in FIG. 4. In an alternative configuration, the rim 60 of the engagement ring 20 may extend beyond the flange end 80 of the nut, as seen in FIG. 10.

Figure 17:
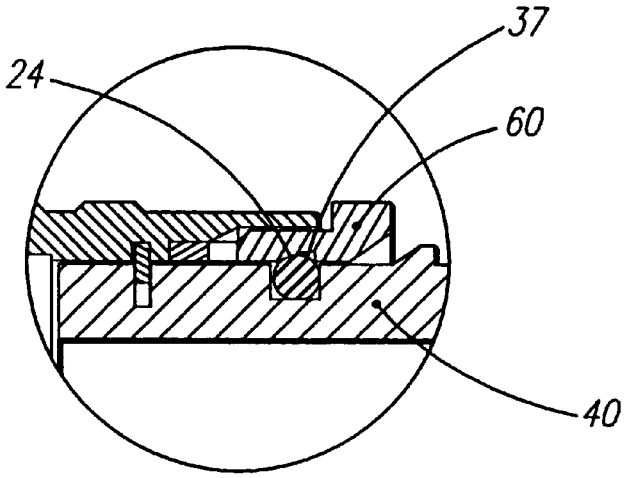
FIG. 17 is similar to FIG. 16, showing yet another alternative lock ring drive element.

In another alternative arrangement, a garter spring 36 may be utilized as the drive ring, as seen in FIG. 16. In yet another alternative arrangement, an elastomer ring 37 may be utilized as the drive ring, as shown in FIG. 17.

Figure 18:
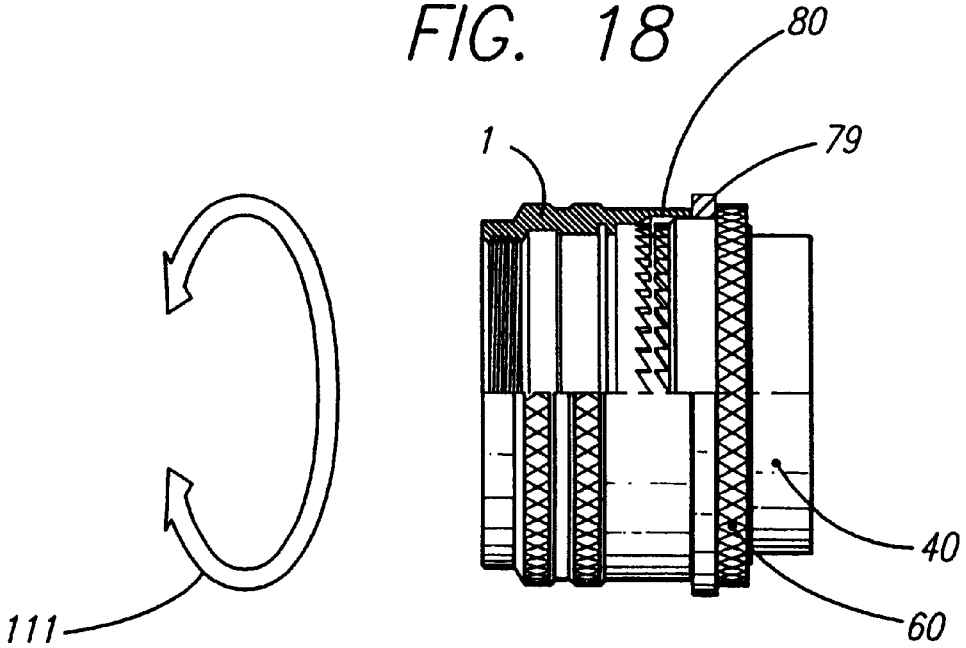
FIG. 18 is similar to FIG. 13 showing the coupling in the factory pre-set unlocked position.

In another alternative arrangement, the coupling may be assembled at the manufacturing site with an additional annular ring 79 positioned between the rim 60 of the engagement ring 20 and the inner flange 80 of the nut 1. This construction is shown in FIG. 18. With the additional ring 79 in place, the nut may be rotated in either direction, as shown by the arrow 111, without engagement of the teeth. After the coupling is in the desired position with the cable and the connector, and the coupling is ready for locking engagement, the installer removes the ring 79 and pushes the nut to bring the teeth into the desired engagement. Once the teeth of the configuration shown in FIG. 18 are engaged, it is nearly impossible to have the components rotate relative to each other and loosen the coupling.

I claim:

1. A cable connector coupling having a nut for attachment to a cable connector and a body joined to said nut so that the cable of the cable connector passes through said nut and body, said nut having a first internal annular groove and said body having a first external annular groove, with a lock ring positioned in said first grooves so that said nut and body translate axially together, an annular engagement ring positioned around said body for sliding axially on said body, said engagement ring having a second internal annular groove and said body having a second external annular groove, with a drive ring positioned in said second grooves, said nut and engagement ring having axially directed first interengaging means for varying the overall axial length of said nut and body as said nut is rotated relative to said body, said body and engagement ring having second interengaging means for limiting rotation of said engagement ring relative to said body, said drive ring and body having third interengaging means for urging said first interengaging means into engagement for limiting rotation of said body relative to said nut.

2. A coupling as defined in claim 1 wherein said first interengaging means includes an annular toothed ring as part of said nut and a mating annular toothed ring as part of said engagement ring, with said toothed rings facing each other, and with full 360 degree contact.

3. A coupling as defined in claim 2 wherein the teeth of each of said toothed rings are in the shape of isosceles triangles.

4. A coupling as defined in claim 2 wherein the teeth of each of said toothed rings are in the shape of non-equal angle triangles.

5. A coupling as defined in claim 2 wherein the teeth of each of said toothed rings have one side parallel to the axis of said coupling and the other side oblique to the axis of said coupling.

6. A coupling as defined in claim 2 wherein said second interengaging means includes means in said engagement ring defining an anti-rotation groove, and a means carried on said body for engagement with said groove.

7. A coupling as defined in claim 2 wherein said nut has a peripheral flange at one end for positioning over a portion of said engagement ring, and said engagement ring has an external annular rib projecting axially beyond said flange of said nut.

8. A coupling as defined in claim 2 wherein said annular toothed ring of said nut is an integral part of said nut.

9. A coupling as defined in claim 2 wherein said annular toothed ring of said nut is formed separate from said nut and slides into said nut.

10. A coupling as defined in claim 2 wherein each of said toothed rings is continuous.

11. A coupling as defined in claim 2 wherein each of said toothed rings is uniform and continuous.

12. A coupling as defined in claim 2 wherein said second internal annular groove of said engagement ring has a varying diameter and said drive ring is resilient providing a varying external diameter.

13. A coupling as defined in claim 12 wherein said drive ring is a resilient snap ring with means defining a gap therein.

14. A coupling as defined in claim 12 wherein said engagement ring has an internal flat bottom detent groove adjacent said second internal annular groove.

15. A coupling as defined in claim 12 wherein said drive ring is a garter spring.

16. A coupling as defined in claim 12 wherein said drive ring is an elastomer ring.

17. A coupling as defined in claim 12 wherein said nut has a peripheral flange at one end for positioning over a portion of said engagement ring, and said engagement ring has an external annular rib projecting axially beyond said flange of said nut.

18. A coupling as defined in claim 1 wherein said second internal annular groove of said engagement ring has a varying diameter and said drive ring is resilient providing a varying external diameter.

19. A coupling as defined in claim 1 wherein said second interengaging means includes means in said engagement ring defining an anti-rotation groove, and a means carried on said body for engagement with said groove.

20. A coupling as defined in claim 1 wherein said nut has a peripheral flange at one end for positioning over a portion of said engagement ring, and said engagement ring has an external annular rib projecting axially beyond said flange of said nut.

21. A coupling as defined in claim 12 wherein said second interengaging means includes means in said engagement ring defining an anti-rotation groove, and a means carried on said body for engagement with said groove.

22. A coupling as defined in claim 21 wherein said means carried on said body includes a key tab on the exterior of said body and projecting outward for engagement with said groove.

23. A coupling as defined in claim 21 wherein said means carried on said body includes a pin carried on said body and projecting outward for engagement with said groove.

24. A coupling as defined in claim 21 wherein said nut has a peripheral flange at one end for positioning over a portion of said engagement ring, and said engagement ring has an external annular rim projecting axially beyond said flange of said nut.

25. A coupling as defined in claim 21 wherein said nut has a peripheral flange at one end for positioning over said engagement ring, with said flange and engagement ring of sizes such that said flange overlays said engagement ring substantially covering said engagement ring.

26. A coupling as defined in claim 25 including an additional annular ring for positioning around said engagement ring between said engagement ring external annular rib and the end of said nut flange for preventing engagement of said first interengaging means, said additional annular ring being flexible for removal from said coupling.

27. A cable connector coupling having a nut for attachment to a cable connector and a body joined to said nut so that the cable of the cable connector passes through said nut and body, said nut having a first internal annular groove and said body having a first external annular groove, with a lock ring positioned in said first grooves so that said nut and body translate axially together, an annular engagement ring positioned around said body for sliding axially on said body, said engagement ring having a second internal annular groove and said body having a second external annular groove, with a drive ring positioned in said second grooves, said nut and engagement ring having axially directed first interengaging means for varying the overall axial length of said nut and body as said nut is rotated relative to said body, said body and engagement ring having second interengaging means for limiting rotation of said engagement ring relative to said body, said drive ring and body having third interengaging means for urging said first interengaging means into engagement for limiting rotation of said body relative to said nut, with said first interengaging means including an annular toothed ring as part of said nut and a mating annular toothed ring as part of said engagement ring, with said toothed rings facing each other, and with said second internal annular groove of said engagement ring having a varying diameter and said drive ring is resilient providing a varying diameter, and wherein said second interengaging means includes means in said engagement ring defining an anti rotation groove, and a means carried on said body for engagement with said groove.

* * * * *